United States Patent [19]

McNeil

[11] Patent Number: 4,499,832

[45] Date of Patent: Feb. 19, 1985

[54] APPARATUS AND METHOD FOR MATERIAL DISPOSAL

[76] Inventor: Roderick J. McNeil, 395 N. Candlewood Lake Rd., New Milford, Conn. 06776

[21] Appl. No.: 565,222

[22] Filed: Dec. 23, 1983

[51] Int. Cl.[3] ..... F23G 7/04

[52] U.S. Cl. ..... 110/238; 110/237; 110/250; 431/170

[58] Field of Search ..... 110/235, 237, 238, 250, 110/346; 431/7, 170

[56] References Cited

U.S. PATENT DOCUMENTS

| | | | |
|---|---|---|---|
| 2,657,745 | 11/1953 | Bleecker | 431/7 |
| 3,613,607 | 10/1971 | Hacker | 110/250 X |
| 3,672,839 | 6/1972 | Moore | 431/7 X |
| 3,810,732 | 5/1974 | Koch | 431/7 |
| 3,934,969 | 1/1976 | Hoda et al. | 110/238 X |
| 4,087,962 | 5/1978 | Beremand et al. | 431/7 X |
| 4,259,910 | 4/1981 | Warren et al. | 110/250 X |
| 4,316,878 | 2/1982 | Akune et al. | 110/238 X |

*Primary Examiner*—Edward G. Favors
*Attorney, Agent, or Firm*—David Fink

[57] ABSTRACT

An apparatus and method for the environmentally safe disposal of material by combustion using a hot body having a plurality of open pores.

15 Claims, 1 Drawing Figure

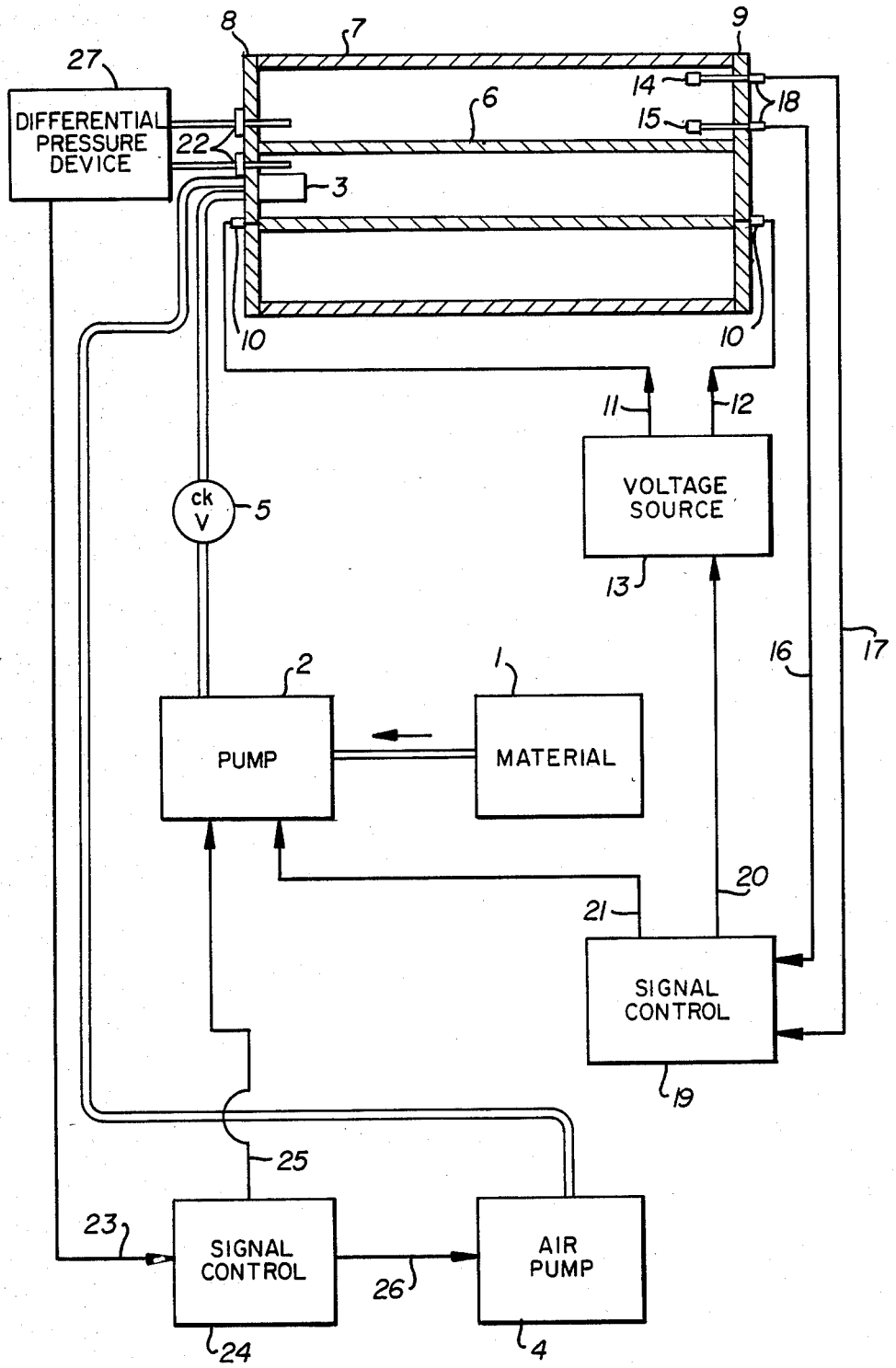
DIFFERENTIAL PRESSURE DEVICE
VOLTAGE SOURCE
ck V
PUMP
MATERIAL
SIGNAL CONTROL
SIGNAL CONTROL
AIR PUMP
1
2
3
4
5
6
7
8
9
10
10
11
12
13
14
15
16
17
18
19
20
21
22
23
24
25
26
27

APPARATUS AND METHOD FOR MATERIAL DISPOSAL

FIELD OF THE INVENTION

The invention relates to an apparatus and method for the disposal of materials which may be toxic and dangerous to the environment. The invention does not require complex equipment and enables even relatively small producers of dangerous materials to provide an environmentally safe disposal of the material. Such materials include pathological matter, pesticides, toxic organic liquids, organic solvents, etc.

BACKGROUND OF THE INVESTIGATION

Generally, state and federal laws have made is essential for businesses of all types and sizes to be concerned with the environmentally safe disposal of waste materials. Large manufacturers which produce large quantities of waste material have the capability of purchasing expensive equipment for the safe treatment of waste materials.

Companies which produce relatively small quantities of toxic materials cannot justify the cost of the complex equipment required according to the prior art and must ship the waste material to some place which accumulates large quantities of the waste material and has the necessary equipment for dealing with the waste material.

Solvents are one of the common types of waste materials which must be disposed of safely. Typically, the solvents are accumulated in drums and these drums are sent to a facility which can properly treat the solvents in order to protect the environment. Such an operation can be very costly and a hardship for a small organization.

U.S. Pat. No. 3,547,056 relates to a relatively small incinerator for burning materials including pathological matter, pesticides, toxic organic solids, liquid sludges and ordinary refuse. The incinerator includes a rotatable primary combustion chamber, means to rotate the chamber; means to introduce air into the chamber; a stationary chamber; connecting means between the chambers; a venturi throat means in the connecting means; and burner means associated with the venturi throat means.

In general, the material is mixed with air in the primary combustion chamber and ignited to combust. Material which will not support combustion requires external fuel. The final burning of combustible gases and any fine particulate material is accomplished, according to the patent, by a burner near the venturi throat.

The exhaust from the second furnace can include ash and finely divided particulates so a baffle and/or filtering system may be needed.

The incinerator is complex and costly to implement and small only by comparison to a large scale system.

There exists a significant need for a safe and reliable, but economical, apparatus and method for the disposal of materials which can be harmful to the environment.

SUMMARY OF THE INVENTION

The invention relates to an apparatus for the environmentally safe disposal of material and is its broadest embodiment comprises means for producing an aerosol of the material; a first enclosure surrounding the aerosol and having a first porous portion including a first plurality of open pores; the first porous portion being capable of being maintained at a predetermined temperature to combust the aerosol; a second enclosure surrounding the first enclosure and having a second porous portion including a second plurality of open pores; means for supplying an oxidizing atmosphere to the first enclosure for the combustion of the aerosol; and means to raise the temperature of the first porous portion to the predetermined temperature; whereby the aerosol is combusted near and within the first porous portion and a flow of gases occurs from the interior of the first enclosure out through the first and second porous portions.

Preferably, the predetermined temperature is about 1700° C.

Preferably, the means for producing an aerosol produced particles primarily in the range of from about 1 micron to about 10 microns.

Preferably, the first enclosure comprises porous tungsten carbide having at least 70% open pores with the diameters of the pores being in the range of from about 30 microns to about 100 microns and having a tortuosity greater than about $2\frac{1}{2}$.

More preferably, the average diameter of the open pores of the first enclosure is in the range of from about 70 microns to about 100 microns.

Preferably, the first and second enclosures are coaxial cylinders and the first porous portion is porous tungsten carbide having at least 70% open pores with diameters in the range of from 70 microns to 100 microns and having a tortuosity greater than about $2\frac{1}{2}$ while the second enclosure has an average open pore size of about 5 microns.

Preferably, the means to raise the temperature of the first portion to the predetermined temperature comprises a voltage source connected to the first portion so that the current passing through the first portion resistively heats the first portion.

Preferably, the apparatus further comprises means to sense the temperature of the first porous portion and means to maintain the temperature of the first porous portion within a predetermined temperature range.

More preferably, the apparatus further comprises means to sense the temperature of the first porous portion; means to sense the difference in temperature between the temperature of the space between the first and second enclosures and the temperature of the first porous portion; means to maintain the temperature of the first porous portion within a first predetermined temperature range; and means to adjust the combustion rate of the aerosol to maintain the sensed difference in temperature within a second predetermined temperature range.

The combustion rate of the aerosol can be modified by a change in the temperature of the first porous portion, the rate of delivery of the aerosol, the rate of supply of the oxidizing atmosphere as well as the composition of the oxidizing atmosphere, and combinations of these.

Preferably, the oxidizing atmosphere is air under pressure because of the economics. The rate at which the air is supplied influences the combustion rate, maintains the second enclosure under pressure, and can provide cooling to the means for producing an aerosol. Other oxidizing atmospheres can be used and may be preferable for some materials requiring a stronger oxidizer.

A further improvement comprises means for sensing the difference in pressure between the pressure of the interior of the first enclosure and the pressure of the space between the first and second enclosures.

Another improvement is means for adjusting the supply of the oxidizing atmosphere and/or the rate of aerosol production in response to the difference in pressure between the pressure of the interior of the first enclosure and the pressure of the space between the first and second enclosures.

The invention also relates to a method for the environmentally safe disposal of material and in the broadest embodiment comprises producing an aerosol of the material in an oxidizing atmosphere; and moving the aerosol under pressure to a plurality of tortuous open pores in a body having a predetermined temperature to combust the aerosol with the open pores having a size distribution and path length distribution whereby all of the aerosol is consumed.

DISCUSSION OF THE INVENTION

The invention provides a simple, economical, and safe apparatus and method for the disposal of materials which can be made into an aerosol. Waste material such as a liquid hydrocarbon solvent is made into an aerosol inside a highly porous enclosure having a temperature of preferably about 1700° C. Such hydrocarbons are considered very difficult to dispose of in the art. It is known in the prior art that polycyclic aromatic hydrocarbons have their bonds broken at about 1700° C. so that the use of a temperature of about 1700° C. for the first porous portion provides a safeguard for the disposal of hydrocarbons requiring a high degree of assurance as to the combustion of the material.

An oxidizing gas such as air under pressure is brought into the first enclosure. The air can be supplied both through the means for producing the aerosol and separately near the means for producing the aerosol so that the flow of air cools the means for producing the aerosol and mixes with the aerosol. Preferably, the first enclosure is substantially the first porous portion and thereby provides substantially no resistance to the air pressure. The second enclosure is preferably substantially the second porous portion and encloses the first enclosure but has relatively small open pores thereby inhibiting the flow of air. The gases, however, must pass through the second enclosure in order to maintain a flow of gases out of the first enclosure.

The aerosol cloud moves towards the surface of the first porous portion and is subject to a steep temperature gradient in the vicinity of the first porous portion. This temperature gradient, as well as the tortuous paths through the first porous portion, results in the formation of carbon dioxide and carbon monoxide.

The rate that air is supplied, as well as the rate that the aerosol is supplied, can be adjusted so that the products of combustion are substantially carbon dioxide and carbon monoxide with substantially no formation of carbon. All of the aerosol is consumed in the apparatus.

The operation of the apparatus depends on the interrelationship between a number of factors which can be modified to optimize performance.

Devices for producing aerosols are commercially available. Such a device is characterized by a capability of producing aerosol for which the diameters of the components of the aerosol generally are within a given range for a given set of parameters. It is expected that there will be components of the aerosol having diameters both smaller that the lower limit and greater than the upper limit of the given range. It i the upper limit of the diameter of the aerosol components which is of particular interest with respect to the first porous portion.

Porous material structure and methods for producing them are well known in the prior art. In particular, it is known in the art to produce porous bodies capable of being maintained at a temperature of about 1700° C. and processing open pores having diameters generally within a predetermined range and having a tortuosity greater than a predetermined value.

Measurements for determining the parameters of the pores can be carried out using known procedures such as set forth in American Standard Testing Measurement (ASTM). Porosity by mercury penetration is set forth in ASTM C699, pore diameter is set forth in ASTM D721, and pore volume distribution is set forth in ASTM C493-70.

As used herein, "tortuosity" is defined as the ratio of the average length of an open pore divided by the overall thickness of the porous body.

Generally, the diameter of the open pores are characterized as being within a range even though some open pores are less than the lower limit and some open pores are more than the upper limit of the range.

The lower limit of the diameter of the open pores of the first porous portion is preferably greater than the upper limit for the diameter of the components of the aerosol so that substantially all of the components of the aerosol can enter into the open pores of the first porous portion. The diameter range of the open pores of the first porous portion should be selected to receive the aerosol.

Typically, the open pores of the first porous portion have tortuous paths which will provide a dwell time sufficient to combust the aerosol. Of course, the internal pressure of the first enclosure is a factor as to the transit time of the aerosol through the open pores of the first porous portion.

The larger the first porous portion, the greater the amount of material which can be consumed for a given range of open pores and tortuosity. A tortuosity of at least $2\frac{1}{2}$ will provide a desirable delay of components of the aerosol for a wide range of other conditions in order to achieve complete consumption of the material.

The size and shape of the first porous portion are not critical. It has been determined that a hollow cylindrical shape composed of porous tungsten carbide is preferable and can be produced by a commercial company.

The means to produce the aerosol purchased commercially for the invention produced a cylindrically dispersement of the aerosol and was particularly compatible with the shape of the first enclosure.

An open pore diameter range of from about 70 microns to about 100 microns for the first porous portion was found to be satisfactory for an aerosol having diameters in the range of from about 1 micron to about 10 microns.

The second enclosure provides several provides functions including a fire wall, a control on the flow of gases out of the first enclosure, and a filter for soot. Typically, the second enclosure can have a temperature of a few hundred degrees less than the first enclosure temperature during operation of the apparatus, depending upon the relative sizes, rate of combustion, and internal pressure of the first enclosure.

The range of diameters of the open pores of the second porous portion as well as the size of the second porous portion should be such that for the operating conditions the rate of movement of the aerosol through the first porous portion will consume all of the aerosol. Generally, the pore diameters of the second porous portion should be greater than about 2 microns and less than about 20 microns.

The operating conditions should be preferably selected so that the material is combusted to carbon dioxide and carbon monoxide. Nevertheless, it can be expected that carbon can be produced as a result of the material being consumed. The carbon constitutes soot and the open pores of the second porous portion should preferably have diameters sufficiently small to inhibit soot. At least one additional enclosure with a porous portion can be used around the second enclosure. The additional enclosure can be used to inhibit soot or as an additional fire shield.

At the start, sufficient energy must be put into the first porous portion in order to raise its temperature to the predetermined temperature. It is convenient to supply the energy through an applied voltage to the first enclosure from a voltage source. After the apparatus is in operation, heat will be generated by the combustion of the material and the supplied electrical energy can be varied accordingly. This can be accomplished through a temprature sensor on or near the first porous portion and a feedback loop from the temperature sensor to the voltage source for varying the supplied electrical energy.

It is advantageous to use a differential pressure device for measuring the difference in pressure between the pressure in the first enclosure and the pressure in the space between the first and second enclosures. To some degree, this difference in pressure is a measure of the soot which collects on or in the first porous portion. That is, an increase in the differential pressure could indicate that the first porous portion is becoming obstructed. An increase in the differential pressure could also indicate that the heat content of the combusted material such as a solvent is very high and is formed a compression front. A signal produced from the differential pressure device can be used to control an air pump to compensate for an increase in the differential pressure, and/or control the rate at which the material is being delivered to the first enclosure.

BRIEF DESCRIPTION OF THE FIGURE

The sole FIGURE shows a diagramatic block diagram of a preferred embodiment of the invention.

EXAMPLE

The diagramatic block diagram shown in the FIGURE shows many features of the invention. Material such as a solvent in tank 1 is pumped by pump 2 to a means for producing an aerosol such as device 3. Device 3 is producing droplets having diameters in the range of from about 1 micron to 10 microns. The device 3 is marketed under the trade name SONIMIST by Heat System-Ultrasonics, Inc., Farmingdale, NY. Air pump 4 supplies air for producing the aerosol. Check valve 5 prevents combustion from traveling down to the pump 2.

First enclosure 6 and second enclosure 7 are coaxial hollow cylinders. End plates 8 and 9 provide gas seals for the respective enclosures 6, 7 and are composed of a machinable electrically nonconductive glass marketed under the trade name MACOR by Corning, Inc., Corning, NY. Feed through seals 10 seal end plates 8 and 9 for the electrical leads 11 and 12.

The first enclosure 6 is 10 inches long, has a 2 inch outside diameter, and is $\frac{1}{8}$ inch thick. The second enclosure 7 is a hollow cylinder 10 inches long, has a $6\frac{1}{2}$ inch outside diameter, and is 1/16 inch thick.

First enclosure 6 is composed of porous tungsten carbide, has at least 70% open pores, and has pore diameters in the range of from about 70 microns to about 100 microns. The tortuosity is greater than $2\frac{1}{2}$.

The second enclosure 7 is composed of low corrosion stainless steel marketed under the trade name HASTELLOY by Carpenter Steel Co. and has an average open pore diameter of about 5 microns.

The electrical leads 11 and 12 from voltage source 13 pass through end plates 8 and 9 and are electrically connected to the first enclosure 6 in order to heat the first enclosure 6 resistively during the operation of the apparatus.

Temperature sensors 14 and 15 provide electrical signals through electrical leads 16 and 17 which pass through feed through seals 18 and are connected to a signal control 19. Signal control 19 can be a commercially available device which produces a control signals for the voltage source 13 and pump 2 through electrical leads 20 and 21, respectively.

The signal control 19 produces a signal based on the electrical signal from the temperature sensor 15 so that the voltage source 13 is adjusted to maintain the temprature of the first enclosure 6 within a predetermined temperature range. The signal control 19 also produces a signal based on the electrical signals from the temperature sensors 14 and 15 so that the pump 2 is adjusted to supply the material 1 at a rate for which the temperature difference of the temperature sensors 14 and 15 is usually a few hundred degrees.

The temperature difference between temperature sensors 14 and 15 provides information on the combustion rate of the material. This information can be used to change the rate at which material is delivered to the first enclosure 6 and/or the electrical energy used to heat the first enclosure 6. In the preferred embodiment the pump 2 is varied only.

A differential pressure device 21 is connected through feed through seals 22 for measuring the difference in pressure between the pressure in the first enclosure 6 and the pressure in the space between the first enclosure 6 and the second enclosure 7. This difference in pressure provides an electrical signal through electrical lead 23 to signal control 24 which produces signals to change pump 2 and air pump 4 through electrical leads 25 and 26, respectively. Signal control 24 maintains the pressure in the first enclosure 6 within a predetermined range and maintains the pressure difference between the pressure in the first enclosure 6 and the pressure in the space between the enclosures 6, 7 within a predetermined pressure range. Signal control 24 can be a commercially available device.

For a material 1 of benzene, the rate of delivery to the enclosure 6 was about 60 milliliters per minute, the pressure in the enclosure 6 was about 60 psig and the pressure in the enclosure 6 was 3 psi higher than the pressure in the space between the enclosures 6, 7. The first enclosure 6 was maintained at a temperature of about 1700° C.±25° C., while the second enclosure 7 was at a temperature in the range of from about 1200° C. to about 1400° C.

I claim:

1. An apparatus for the environmentally safe disposal of material, comprising:

means for producing an aerosol of the material;

a first enclosure surrounding the aerosol and having a first porous portion including a first plurality of open pores;

the first porous portion being capable of being maintained at a predetermined temperature to combust said aerosol;

a second enclosure surrounding the first enclosure having a second porous portion including a second plurality of open pores;

means for supplying an oxidizing atmosphere to said first enclosure for the combustion of said aerosol; and means to raise the temperature of the first porous portion to said predetermined temperature; whereby said aerosol is combusted near and within said first porous portion, and a flow of gases occurs from the interior of said first enclosure out through said first and second porous portions.

2. The apparatus of claim 1, wherein said predetermined temperature is about 1700° C.

3. The apparatus of claim 1, wherein said means for producing an aerosol produces particles in the range of from about 1 micron to about 10 microns.

4. The apparatus of claim 1, wherein said first enclosure comprises at least 50% open pores with the diameters of the pores being in the range of from about 30 microns to about 100 microns and said pores having a tortuosity greater than about $2\frac{1}{2}$.

5. The apparatus of claim 4, herein said first enclosure comprises porous tungsten carbide.

6. The apparatus of claim 4, wherein said pores have diameters in the range of from about 70 microns to about 100 microns.

7. The apparatus of claim 5, wherein said second enclosure has an average open pore diameter of about 5 microns.

8. The apparatus of claim 1, wherein said means to raise the temperature of the first portion comprises a voltage source and means to connect said voltage source to said first porous portion.

9. The apparatus of claim 8, further comprising means to sense the temperature of said first porous portion and means to maintain the temperature of said first porous portion within a predetermined temperature range.

10. The apparatus of claim 1, further comprising means to sense the temperature of said first porous portion; means to sense the difference in temperature between the temperature of the space between said first and second enclosures and the temperature of said first porous portion; means to maintain the temperature of said porous portion within a first predetermined temperature range; and means to adjust the combustion rate of said aerosol to maintain the sensed difference in temperature within a second predetermined temperature range.

11. The apparatus of claim 10 wherein said oxidizing atmosphere comprises air.

12. The apparatus of claim 1, further comprising means for sensing the difference in pressure of the pressure within the interior of said first enclosure and the pressure within the space between said first and second enclosures; and means for adjusting the supply of the oxidizing atmosphere in response to said pressure difference to maintain said pressure difference within a predetermined pressure range.

13. The apparatus of claim 1, wherein the predetermined temperature is about 1700° C.; said material is a solvent; and said oxidizing atmosphere is air.

14. The apparatus of claim 1, wherein said predetermined temperature is about 1700° C.; the diameters of the open pores of said first porous portion are greater than the largest diameter of the particles of said aerosol.

15. The apparatus of claim 14, wherein the diameters of the pores of said second porous portion are in the range of from about 2 microns to about 20 microns.

* * * * *